US005252022A

United States Patent [19]

Culp et al.

[11] Patent Number: 5,252,022

[45] Date of Patent: Oct. 12, 1993

[54] QUICK ATTACHMENT ASSEMBLY FOR LOADER IMPLEMENTS

[75] Inventors: Ralph N. Culp, Vineland; Gordon D. Hubbard, Beansville; James Cosby, Welland; John R. McMillan, Welland; Daniel R. Fuzzen, Welland, all of Canada

[73] Assignee: Deere & Company, Moline, Ill.

[21] Appl. No.: 785,359

[22] Filed: Oct. 30, 1991

[51] Int. Cl.[5] ..... E02F 3/81

[52] U.S. Cl. ..... 414/723; 37/411; 172/273

[58] Field of Search ..... 414/723; 37/231, 118 R, 37/118 A; 172/273

[56] References Cited

U.S. PATENT DOCUMENTS

| | | | |
|---|---|---|---|
| 3,718,222 | 2/1973 | Foster . | |
| 3,934,738 | 1/1976 | Arnold | 414/723 |
| 4,243,356 | 1/1981 | Takojima . | |
| 4,345,872 | 8/1982 | Arnold | 414/723 X |
| 4,452,560 | 6/1984 | Coyle et al. . | |
| 4,509,768 | 4/1985 | Haug | 172/273 X |

FOREIGN PATENT DOCUMENTS

| | | | |
|---|---|---|---|
| 1242996 | 10/1988 | Canada | 37/231 |

*Primary Examiner*—Michael S. Huppert

*Assistant Examiner*—Donald W. Underwood

[57] ABSTRACT

An implement is coupled to the forward ends of a pair of loader lift arms through the medium of an attachment assembly comprising a pair of implement carriers respectively vertically pivotally mounted to the pair of loader lift arms by a connector rod that extends through aligned holes provided in lower locations of the carriers, the connector rod being releasably fastened to each of the carriers so that the latter are pivoted in unison by hydraulic cylinders connected between the lift arms and upper locations of the carriers. The attachment assembly further includes a pair of downwardly opening hooks welded to upper locations of the back side of the implement and including arcuate portions respectively receiving cylindrical bars defining upper ends of the pair of carriers. Also fixed to the back side of the implement are a pair of rearwardly projecting, tapered connecting pins that are respectively received in holes provided in mounting plates forming lower forward portions of the carriers. The pins are located at outward locations which are visible to an operator so that the mounting of the implement to the carriers can be more easily effected. Quick clips are received through cross bores provided in the mounting pins so as to releasably maintain the connection between the implement and carriers.

11 Claims, 2 Drawing Sheets

FIG. 3
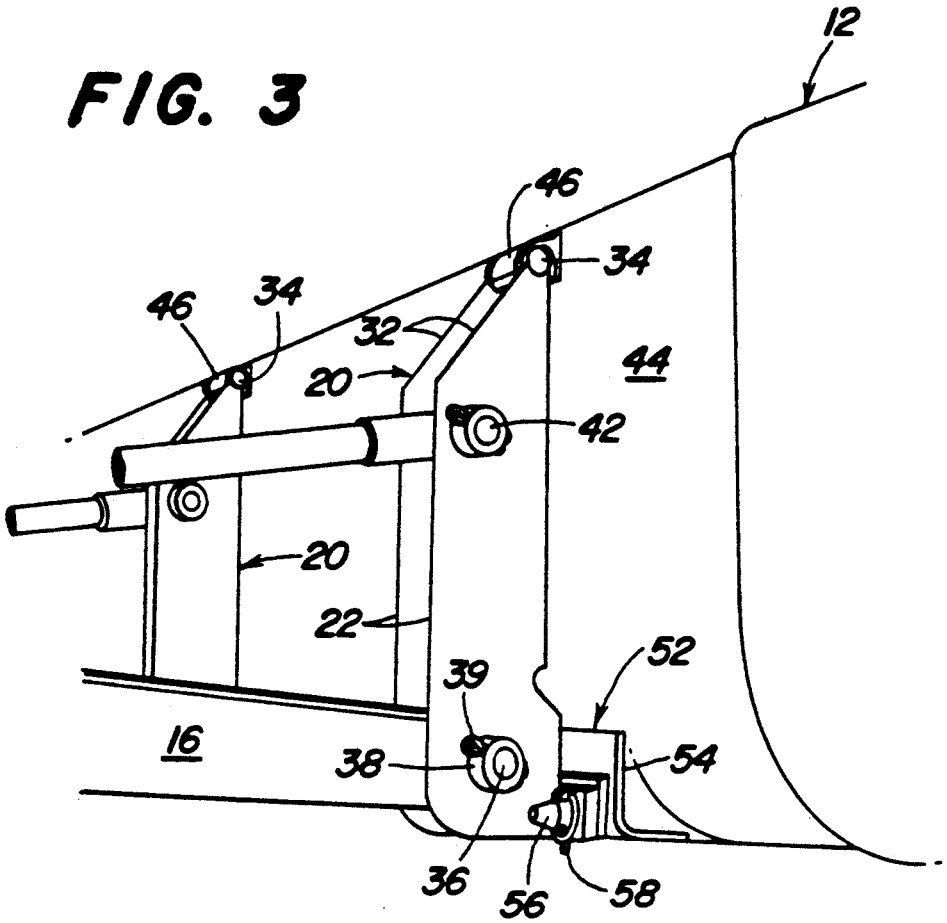
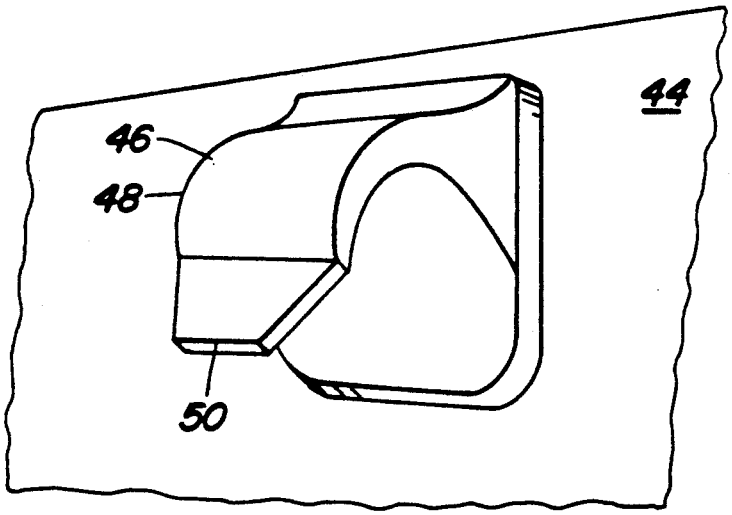
FIG. 4

QUICK ATTACHMENT ASSEMBLY FOR LOADER IMPLEMENTS

BACKGROUND OF THE INVENTION

The present invention relates to loaders that are mounted to tractors and more specifically relates to means for quickly attaching implements to the ends of loader lift arms.

Designers have long worked to create designs for connecting implements to the lift arms of tractor-mounted loaders with the view being toward ease of attachment. While some of these designs have been quite effective in that the connection of an implement to the loader arms occurs automatically upon the operator manipulating certain structure carried by the arms into fitting engagement with complementary structure carried by the implement, these designs have the disadvantage or drawback that they include a number of different parts that are relatively difficult to manufacture or assemble and, therefore, expensive and thus are not ideal for being provided as standard equipment.

SUMMARY OF THE INVENTION

According to the present invention there is provided a quick attachment assembly, which is constructed for overcoming the above-mentioned disadvantages, for connecting implements to the lift arms of a tractor-mounted loader.

A broad object of the invention is to provide an attachment assembly that affords easy attachment of implements to loader lift arms while being of a simple, durable construction.

A more specific object of the invention is to provide a quick attachment assembly comprising a pair of transversely spaced, downwardly opening hooks carried at the backside of the implement in respective locations spaced above a pair of rearwardly projecting, tapered and apertured pins; and to provide a pair of upright attachment holders or carriers having lower ends respectively vertically pivotally mounted to the forward ends of the loader arms, with hydraulic cylinders being coupled to the attachment holders or carriers for pivoting the same and with the holders including upper ends releasably received in the downwardly opening hooks and including lower apertured plates respectively releasably received on the pins.

Yet a more specific object of the invention is to provide an attachment assembly as described above, but wherein the pair of upright attachment holders or carriers each include a top formed by a cylindrical bar, the bar being the part which is releasably received in the hook.

Another specific object is to provide an attachment assembly, as described above, wherein the aperture in the plate at the bottom of each attachment holder or carrier is located outwardly of the remainder of the bracket so that the operator is able to view the alignment of the pin with the aperture during connection of the implement to the hitch bracket.

These and other objects of the invention will become apparent from a reading of the ensuing description together with the appended drawings.

BRIEF DESCRIPTION OF THE DRAWING

FIG. 3 is right rear perspective view showing the quick attachment assembly as applied to an attachment in the form of a bucket.

FIG. 4 is a right rear perspective view showing the right downwardly opening hook of the quick attachment assembly.

DESCRIPTION OF THE PREFERRED EMBODIMENT

Preliminarily, it is to be noted that parts or elements may be described herein as being in pairs when only one of the pair is shown. In such cases, it is to be understood that the unshown part or element is similar if not identical to the one shown.

Figure 1:
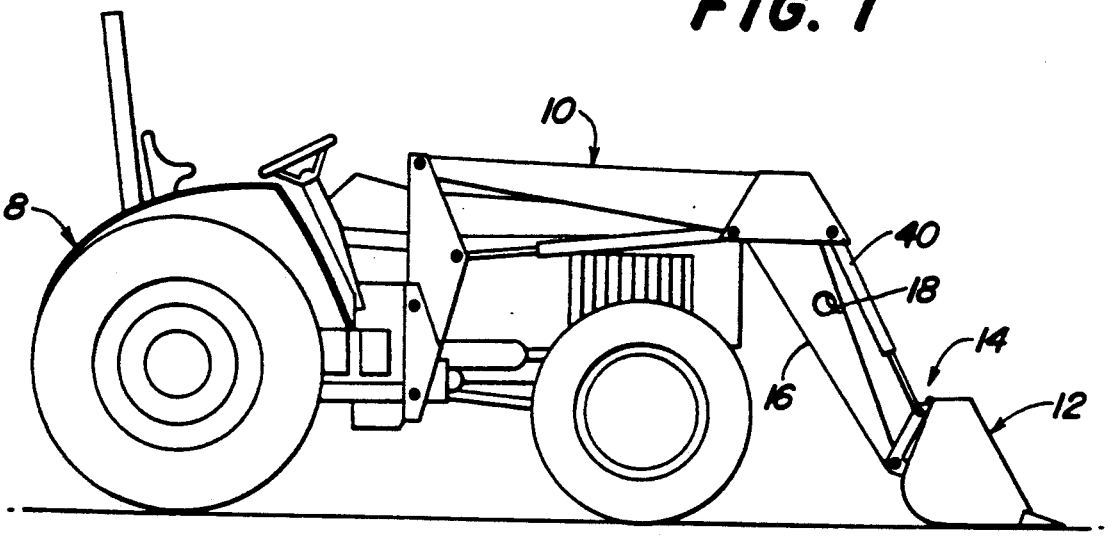
FIG. 1 is a right side elevational view showing a tractor-mounted loader embodying the quick attachment assembly of the present invention.

Referring now to FIG. 1, there is shown a tractor 8 having a loader 10 mounted thereon and connected to an implement or attachment 12 by an attachment or quick coupler assembly 14. Implement 12 is shown in the form of a bucket, however, it will be understood that the attachment assembly 14 disclosed herein can be utilized with various types of implements including blades, forks, grapples, baskets and the like.

The loader 10 includes a boom formed by a pair of spaced apart lift arms 16 interconnected by a cylindrical tubular cross member 18. The attachment assembly 14 includes a pair of identical, upright carriers or hitch members 20 which are each formed by a blank of metal bent so as to form a channel-like section including a pair of parallel spaced side walls 22 joined by a front wall 24. The side walls 22 extend below the front wall 24 and cooperate to form a forward projection 26 having upright forward edges to which a mounting plate 28 is welded, the plate being parallel to the front wall 24. The mounting plate 28 has opposite ends respectively extending inwardly and outwardly of the side walls 22 and provided with mounting holes 30. It is here noted that the provision of inner and outer holes 30 in the mounting plates 28 is preferred in order that the carriers be interchangeable so that there is no need to worry about right- and left-hand parts during assembly. Upper edges 32 of the side walls 22 of each of the carriers 20 incline upwardly and forwardly and a horizontal cylindrical bar 34 is welded to the edges 32 and the top of the front wall 24 so as to form an upper most portion of the carrier.

The carriers 20 are respectively vertically pivotally connected to forward ends of the lift arms 16. Specifically, each of the lift arms 16 is received between the side walls 22 of a respective carrier 20 and is pivotally secured thereto by a horizontal transverse connector rod 36 that extends through aligned holes provided in the arms 16 and short cylindrical bosses or tubes 38 welded to the side walls 22 of each of the carriers 20. The connector rod 36 is held in place by respective pins 39 which extend through aligned cross bores provided in the tubes 38 and the rod 36. Thus, the rod 36 acts to ensure that the carriers 20 move together in a timed fashion. The carriers 20 are respectively operated to pivot in unison by means of a pair of hydraulic cylinders 40 having their head ends respectively pivotally connected to the pair of lift arms 16 and having their rod ends respectively pivotally connected, as by pins 42, to upper locations of the holders 20.

The attachment assembly 14 also includes simple parts which are attached to the back side of the implement 12 and are designed for cooperating with the carriers 20 for securing the implement for being pivoted together with the carriers and for being positioned by the lift arms 16. Specifically, welded to upper locations of a flat, upright back surface 44 of the implement 12 are flat, base portions of a pair of downwardly opening hooks 46 which are transversely spaced by a distance equal to the spacing of the carriers 20 and are dimensioned for fitting between the side walls 22. As can best be seen in FIG. 4, the hooks 46 each include an upper radiused or arcuate portion 48 sized for receiving the bar 34 at the top of a respective one of the carriers 20, and angled rearwardly from the radiused portion 48 is a tapered guide portion 50 that serves to guide the bar 34 of an associated one of the carriers to the arcuate portion during attachment of the implement to the carrier. Extending horizontally transversely across a lower rear area of the implement 12 is an angle member 52 having its opposite legs welded to the implement such that a first leg 54 extends substantially parallel to the rear implement surface 44. Extending perpendicular to the angle member leg 54 and welded thereto are a pair of tapered pins 56 which are spaced apart transversely by a distance equal to the spacing between the outermost holes 30 of the mounting plates 28 of the carriers 20, the pins 56 being adapted for reception in these holes when the cylindrical bars 34 at the top of the carriers are properly positioned in the arcuate portions 48 of the hooks 46. The tapered pins 56 are each provided with a cross bore which receives a quick clip 58 to hold the implement 12 in secured relationship to the carriers 20. It is here noted that the placement of the tapered pins 56 outwardly of the outer one of the carrier side walls 22 make it possible for an operator to view them during the operation of attaching the implement 12 to the carriers 20, as described in detail below.

Figure 2:
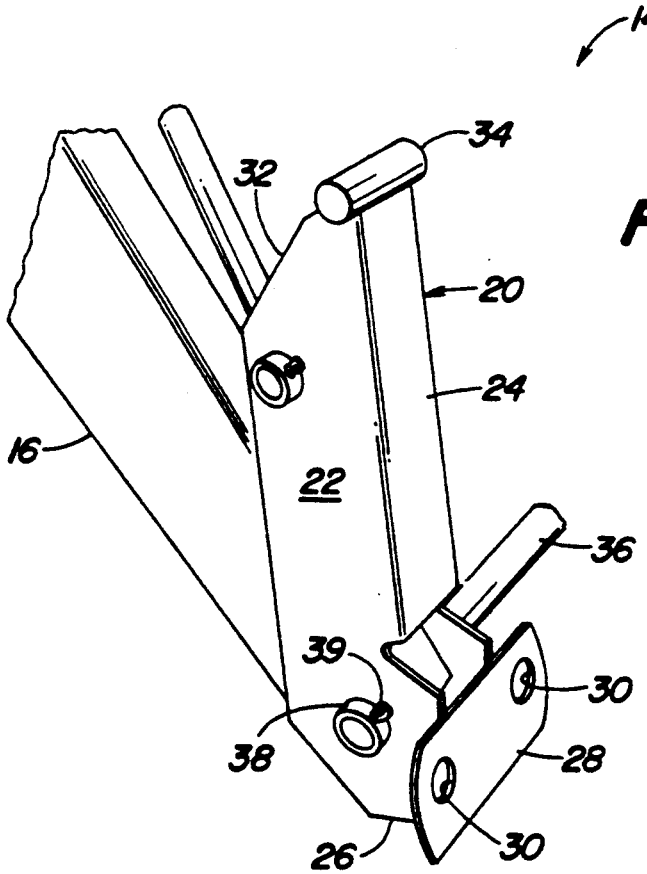
FIG. 2 is a right front perspective view showing that portion of the quick attachment assembly that is coupled to the forward end of the right loader arm.

The operation of the attachment assembly 14 is as follows: Assuming the implement 12 to be detached from the loader 10 and the carriers 20 to be mounted to the forward ends of the loader lift arms 16, as shown in FIGS. 1–3, attachment of the implement may be accomplished by lowering the lift arms 16 and driving the tractor so as to line up the carriers 20 with the hooks 46 at the back side of the implement 12. The hydraulic cylinders 40 are then extended somewhat so that the carriers 20 are tilted forwardly. The tractor 8 is then driven forwardly and the loader lift arms 16 adjusted to bring the cylindrical bars 34 at the tops of the carriers into engagement with the hooks 46 with the inclined guide portions 50 of the hooks serving to guide the bars 34 into the hook radiused section 48. The lift arms 16 are then raised such that the implement 12 is lifted from the ground. Gravity then works to pivot the implement 12 downwardly against the mounting plates 28 with the tapered pins 56 entering the outer holes 30 of the plates 28. The operator then dismounts the tractor and inserts the quick clips 58 through the cross bores in the tapered pins 56. The implement 12 is then attached and ready for use.

We claim:

1. In an attachment assembly for facilitating attachment of an implement to a pair of loader lift arms wherein part of the assembly is embodied in a parallel pair of upright carriers having lower portions respectively connected to forward ends of the lift arms for pivotal movement in respective vertical planes by the action of a pair of hydraulic actuators connected between the lift arms and upper locations of the carriers, and wherein the remainder of the assembly is fixed to a back side of the implement, the improvement comprising: said assembly comprising a pair of downwardly opening hooks spaced transversely from each other at respective upper locations at the back side of the implement and a par of rearwardly projecting pins located on the back side of the implement in respective lower locations below the hooks; said pair of carriers each including an upper end shaped to conform to and being received in a respective one of the hooks and including a lower portion defining a mounting plate having a hole receiving a respective one of the pair of rearwardly projecting pins; and fastener means for capturing said pins within the holes to thereby secure the implement to the carriers.

2. The attachment assembly defined in claim 1 wherein each of said carriers comprise an upper channel-like portion having a forward wall joined to opposite side walls; and each of said hooks extending between the side walls of a respective one of the carriers when the top of the carrier is received within the hook.

3. The attachment assembly defined in claim 2 wherein said hooks each include an arcuate portion extending from the back side of the implement; and said carriers each having a top defined by a cylindrical bar shaped complimentary to the arcuate portion of the hooks.

4. The attachment assembly defined in claim 3 wherein each of said hooks include a rearwardly and downwardly angled, tapered portion joined to said arcuate portion for the purpose of guiding the bar at the top of an associated carrier into the arcuate portion of the hook.

5. The attachment assembly defined in claim 1 wherein said carriers each include a parallel pair of side walls spaced apart in a direction transverse to said vertical planes; and said mounting plate of each carrier bridging and being secured to the side walls of the carrier and having an outer apertured end located outwardly of an outermost one of the side walls of the carrier, whereby the mounting pins and apertures are visible to an operator when the implement is being attached to the carriers so as to aid the operator in bringing the pins and apertures into alignment and the pins are easily accessible for the installation and removal of the fasteners.

6. The attachment assembly defined in claim 5 wherein said carriers are identical with each of said mounting plates further including an inner apertured end located inwardly of an innermost one of the side walls of an associated one of the carriers whereby the carriers are interchangeable for ease in assembly.

7. The attachment assembly defined in claim 5 wherein the pivotal connection of the carriers with the lift arms is established by a connector rod which extends through the carriers and lift arms; and fastening means releasably securing said connector rod to said carriers, whereby the connector rod serves to cause the carriers to pivot in unison.

8. A combination of an implement and a pair of carriers for attaching the implement to the forward ends of the lift arms of a loader, comprising: said implement having a back side provided with a pair of transversely spaced, downwardly opening hooks and a pair of rearwardly projecting connecting pins respectively located below and laterally outwardly of the pair of hooks; and said pair of carriers each including a pair of upright, parallel side walls having lower connection holes adapted for receiving lower pin means for pivotally connecting the carriers to the forward ends of the loader lift arms and having upper connection holes adapted for receiving upper pin means for coupling the rod ends of a pair of hydraulic cylinders to the carriers; said carriers further including upper ends shaped complementary to and being received in said hooks and including mounting plates provided with holes receiving said connecting pins; and fastening means releasably retaining said connecting pins in said holes.

9. The combination defined in claim 8 wherein said carriers are each constructed of a single blank of metal bent to form said side walls and a forward wall joining at least an upper portion of the side walls to thereby define a rearwardly opening channel-like member; a cylindrical bar being mounted to the top of the side walls and the forward wall; and said hooks including arcuate portions respectively embracing said cylindrical bars.

10. The combination defined in claim 9 wherein said hooks each include a tapered guide portion extending from the arcuate portion and being located between the side walls of an associated one of the pair of carriers.

11. The combination defined in claim 10 wherein said carriers are identical and wherein the mounting plate of each includes an inner end provided with a hole, whereby the carriers are interchangeable.

* * * * *